US012402667B1

(12) United States Patent
Ragner et al.

(10) Patent No.: US 12,402,667 B1
(45) Date of Patent: Sep. 2, 2025

(54) BUNGEE BRA

(71) Applicants: Gary Dean Ragner, Gainesville, FL (US); Louise Ann Dapoz, Akron, OH (US)

(72) Inventors: Gary Dean Ragner, Gainesville, FL (US); Louise Ann Dapoz, Akron, OH (US)

( * ) Notice: Subject to any disclaimer, the term of this patent is extended or adjusted under 35 U.S.C. 154(b) by 73 days.

(21) Appl. No.: 17/710,892

(22) Filed: Mar. 31, 2022

Related U.S. Application Data

(60) Provisional application No. 63/168,546, filed on Mar. 31, 2021.

(51) Int. Cl.
*A41C 3/08* (2006.01)
*A41C 3/00* (2006.01)

(52) U.S. Cl.
CPC ..... *A41C 3/0014* (2013.01); *A41C 3/0007* (2013.01); *A41C 3/08* (2013.01)

(58) Field of Classification Search
CPC ... A41C 3/0014; A41C 3/0028; A41C 3/0007; A41C 1/02
USPC ..... 450/1
See application file for complete search history.

(56) References Cited

U.S. PATENT DOCUMENTS

| | | | | |
|---|---|---|---|---|
| 3,707,973 | A * | 1/1973 | Welsch | A41C 1/02 450/109 |
| 3,722,513 | A * | 3/1973 | Erteszek | A41C 3/0007 450/52 |
| 4,413,626 | A * | 11/1983 | Capasso | A41C 3/0028 450/74 |
| 5,045,019 | A | 9/1991 | Capasso et al. | |
| 5,479,791 | A * | 1/1996 | Osborne | D04B 1/246 66/172 R |
| 5,592,836 | A * | 1/1997 | Schuster | A41C 3/0014 450/156 |
| 7,051,557 | B2 * | 5/2006 | Mitchell | D04B 1/106 450/92 |
| 10,231,492 | B1 | 3/2019 | Bastug | |
| 10,721,974 | B2 | 7/2020 | Bastug | |
| 2006/0223415 | A1 | 10/2006 | Watrin et al. | |
| 2010/0297915 | A1 * | 11/2010 | Otto | A41C 3/00 450/86 |

* cited by examiner

*Primary Examiner* — Timothy K Trieu

(57) ABSTRACT

A support bra made with an elastic fabric and having an under band that displays a variable elasticity from top to bottom with a top portion of the under band having a larger elastic tension than a bottom portion of the under band during use. The support bra may also define relaxed elastic zones in the cup area of the support bra where the elastic fabric is deformed by varying amounts across its surface.

16 Claims, 5 Drawing Sheets

BUNGEE BRA

CROSS-REFERENCE TO RELATED APPLICATIONS

Figure 1A:
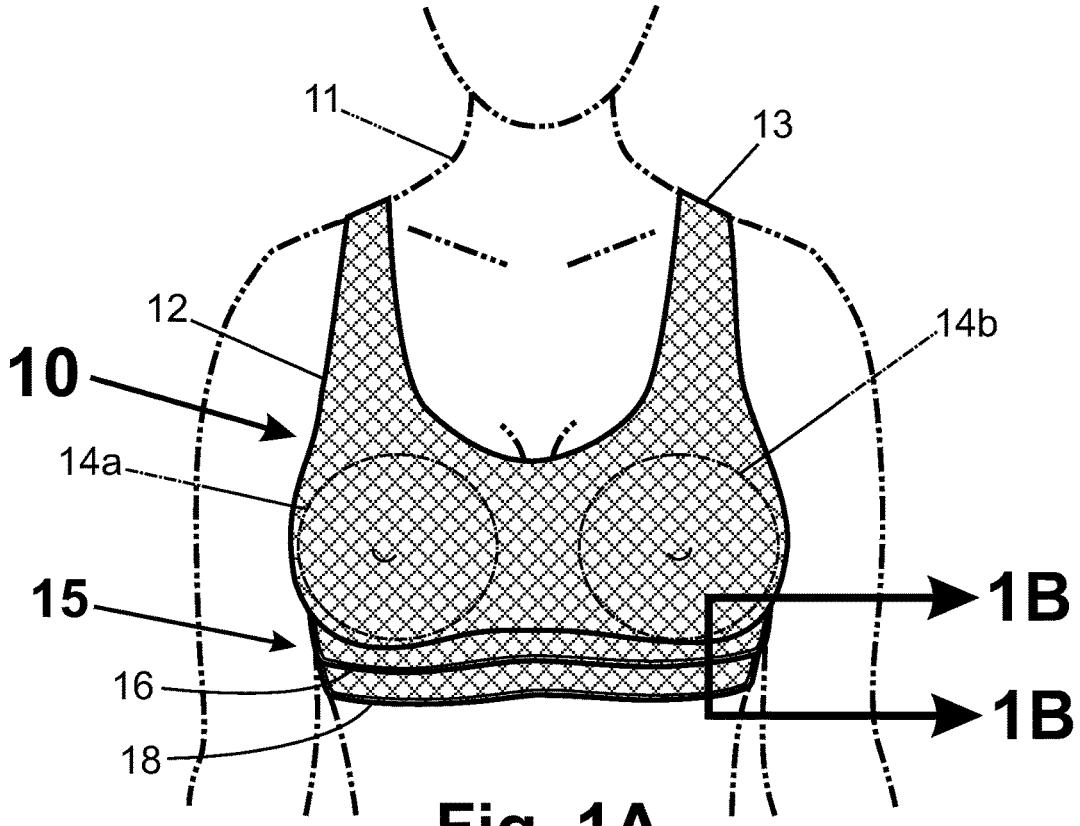

This utility application claims priority from U.S. Provisional Application Ser. No. 63/168,546, filed on Mar. 31, 2021, titled: "BUNGEE BRA" to the Applicants and is hereby requested to be incorporated by reference in its entirety, including any figures, tables, equations or drawings.

FIELD OF INVENTION

The field of this invention relates to support bras, and more specifically to support bras with under bands having a variable elastic coefficient structure.

BACKGROUND OF INVENTION

The present state of the art for women's support bras incorporates various structures to support a women's breasts during sports activities and for general everyday use. However, the combination of providing sufficient support, maintaining the bras position and providing a comfortable fit has eluded the industry until now. This is especially true for larger busted women which have very limited options for sports bras. Often heavy materials are used to provide support, but this causes the bra to be hot and to bind in certain areas. In other cases, the bra is made light-weight and is cool to wear, but these light-weight bras tend not to provide good support, shift during use and/or bunches up on the wearer.

In the prior art, the use of bras by women to support the breasts is well known. According to Dermaware www.dennawear.co.in/the-purpose-of-a-sports-bra, "A sports bra is a bra that provides support to a woman's breasts during physical exercise. Sturdier than typical bras, they minimize breast movement and alleviate discomfort. Many women wear sports bras to reduce pain and physical discomfort caused by breast movement during exercise. Some sports bras are designed to be worn as outerwear during exercise such as jogging. There are also sports bras with extra padding for exercises that involve some kind of trauma to the breasts." Further, for large breasted women it is even more important to provide stability of the breasts during sports activity. This can result in a rather bulky bra that can pinch or bind and also become hot due to the thickness of materials. Thus, providing comfort, support, consistent positioning and good air flow all at the same time becomes a problem for the prior art bras which presently only solve three of these four in any given product.

Present day sports bras also tend to have one or more of the following problems:

1) Does not provide enough support.
2) Mono-Boob where the elastic fabric forces the breasts together in sports bras.
3) Too much pressure on the breasts.
4) Thick material and/or pads make the bra hot and uncomfortable.
5) Fabric does not flex with the breasts and causes chaffing.
6) Side-Boob caused by not enough side support
7) Underwire discomfort is caused by its hard rigid structure and fabric wear.
8) Under band (bottom support band) tends to curl up during use.

SUMMARY

The disclosed support bra embodiments of the invention (i.e., bungee bra) can be formed from nearly any elastic fabric (i.e., stretchable fabric) that incorporates an elastic portion (i.e., a natural rubber, a polyurethane, a Lycra®, a spandex, etc.) can be woven into or bonded to a knitted fabric made with a yarn (i.e., nylon, polyester, cotton, etc.). Such fabrics are common in the prior art. The elastic fabric can incorporate various elastomers within the knit or other stretchable weave to provide a high degree of elasticity to the bra. Thicker elastic fabrics can be used for more active sports where added support is needed. The elastic fabric may also be used in multiple layers to provide additional support. The elastic fabric can be a commercially available elastic fabric such as Lycra® and spandex which can be cut and sewn in a manner similar to existing support bras.

The disclosed bungee bra can have its elastic fabric reshaped by differentially heating the cup areas of the bungee bra while stretched to provide a variable elasticity to the elastic fabric in and around the cup area. This reshaping of the elastic fabric can be done by stretching the elastic fabric over a mold to the desired breast-cup shape for a particular user size and then heating the elastic fabric in the cup areas to a particular temperature to partially relax the elastic polymer(s) in those areas of the clastic fabric. This heating allows the elastic portion of the elastic fabric to relax (i.e., the clastic fabric deforms) and form an indentation that is designed to hold the user's breasts and provide even support, provide even pressure, and also separate the breasts (i.e., no mono-boob). When heat is removed, and the elastic fabric is allowed to cool which tends to set the elastic polymers within the elastic fabric into a new shape. This new shape can be maintained even after washing and drying in conventional washer and dryers. This new shape can provide a more even pressure on the breasts during use and can also solve all the first seven problems listed above in the "Background of Invention". The addition of a graduated or multiple-elasticity under band can provide more elastic material (and greater elastic force) near the top of the under band than at the bottom to solve the eighth problem (i.e., rolling up of the under band) listed above. Thus, the disclosed invention solves all eight recognized problems listed above. Depending on the temperatures used to heat the elastic fabric, the elastic portion may stretch a smaller amount than the stretched shape during heating. This can provide a more even pressure on the user's breasts than prior art bras because of a smooth transition of elastic tension between the relaxed elastic portion (i.e., cup areas) and unrelaxed elastic around those cup areas. The disclosed bungee bra can also have a variable or tapered elastic under band that provides a large elastic force at its upper edge than at its lower edge. This tapering of the elastic coefficient of the under band greatly reduces the chances that the under band will roll up during active sports.

The disclosed bungee bra is designed to solve the eight major problems with prior art bras for women and especially for large breasted women, including but not limited to, 1) providing sufficient support, 2) providing two thermally deformed cup portions in the bra to even out pressure and help separate the breasts to prevent "mono-boob", 3) providing even pressure on the breast while still providing support, 4) using thin air-breathable fabrics that tend not to trap heat and sweat, 5) providing a highly elastic fabric that moves with the user and reduces the chances of chaffing, 6) providing side support to prevent "side-boobs", 7) not using an underwire to improve comfort, and 8) providing an under band that does not curl or roll up.

The disclosed bungee bra can comprise a front and back panel that is sewn together on the sides similar to current sports bras for smaller breasted women. But, by using a special heat treatment process to the cup portion of the front panel, the front flat piece of fabric (i.e., front panel) can be reshaped to have two concave cups each for holding one breast. This special heat treatment consists of deforming the cup portion of the bra into a desirable breast shape and then heating the elastic fabric in each cup area to partially relax the elastic portion of the fabric and provide a permanent deformation in the clastic fabric to provide a more even support across the breasts during use. In some embodiments, the heating temperature can be reduced as one moves away from the center of the cup area to provide a variation in the amount of relaxation (i.e., reshaping, deformation) of the elastic fabric. This can provide a more even pressure on the breasts by relaxing the elastic fabric by a greater amount near the center of the cup area than at its sides. In other embodiments, the elastic relaxation can be greatest near the periphery of the cup areas. In many embodiments, the heating can be done at a low enough temperature that the elastic elements (i.e., elastomers) in the elastic fabric can remain somewhat elastic so that the elastic fabric partially rebounds after the stretching and heat treatment process. However, a high enough temperature should be used to provide the desired permanent reshaping (i.e., heat set process) of the elastic fabric. This heating treatment process (i.e., thermal treatment system) can create cavities within the clastic fabric that the breasts naturally want to rest in and also removes any pressure points that might occur from an untreated flat piece of elastic fabric or a heat treated elastic fabric that has as a sharp transition in properties and/or shape between the heated and non-heat treated portions. The two cups formed by this heat treatment process produce indentations in the fabric to separate the breasts and prevent "mono-boob".

The disclosed bungee bra can also include an under band with a variable or tapered elastic coefficient, where the elastic tension and associated spring constant "k" is greater at the top of the under band (i.e., next to the breasts) than at the bottom. This variation in elastic tension during use can be done with pleats of the elastic fabric which can form stepped changes in the elastic coefficient and by tapering an elastic band to provide a smooth transition between large and small elastic coefficients. While the elastic properties of elastic polymers do not exactly follow Hooke's law: Force=kx (where k=spring constant of the spring, and x=distance stretched) they do come close and is sufficient for understanding the structure of the bungee bra's under band. Essentially what Hooke's law says is that the larger the spring constant "k" the more force the spring creates for the same distance stretched "x". Elastic behaves similarly to springs so we can call "k" an "elastic coefficient" that works similarly in Hooke's equation, but remember the elastic coefficient for elastic polymers (i.e., natural rubber, polyurethane, etc.) is not quite a constant. The disclosed under bands for the bungee bra are designed to have a larger elastic coefficient (i.e., larger spring constant per unit of vertical width) on the top portion of the under band than on the bottom portion of the under band. This means that when the under band is stretched, the top portion of the under band has a larger force on it than a similar width section (i.e., width top to bottom) on the lower portion. One method of achieving this variable or tapered elastic structure is to form a pleat in the elastic fabric at the top of the under band to provide multiple layers of the elastic fabric at the top of the under band while having significantly less elastic fabric on the bottom portion of the under band. In other embodiments, a tapered band of elastic band (i.e., thicker at the top than the bottom) can be bonded to the bottom portion of the bungee bra to provides more elastic material (i.e., elastomer) at the top of the under band than at the bottom. The use of a variable elastic under band can greatly reduce the likelihood of rolling up of the under band because the tapered nature of the under band's construction tends to unroll itself should it start to roll up on the user.

DRAWING FIGURES

FIG. 1A Front Perspective view of a first example variable elastic under band bra (i.e., Bungee bra)

Figure 1B:
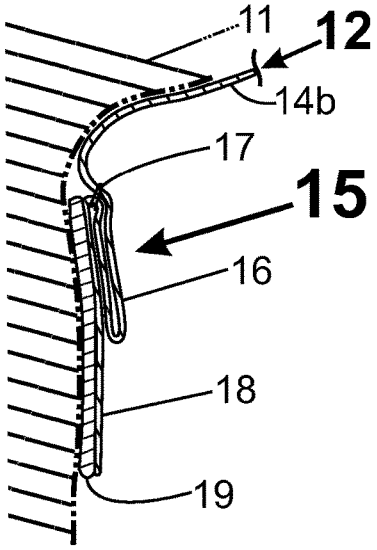
Figure 1C:
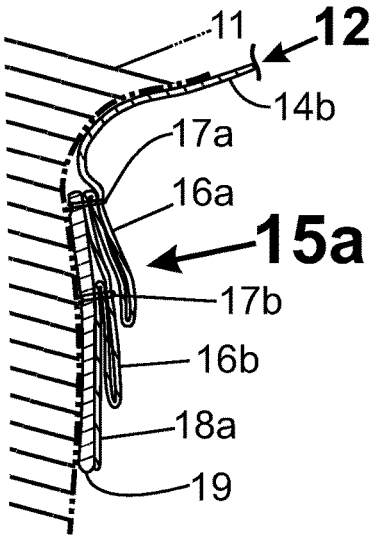
Figure 1D:
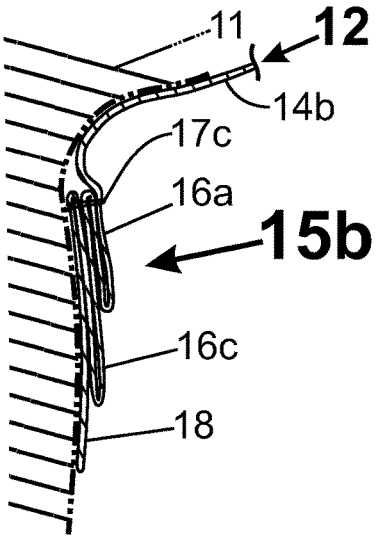
Figure 2A:
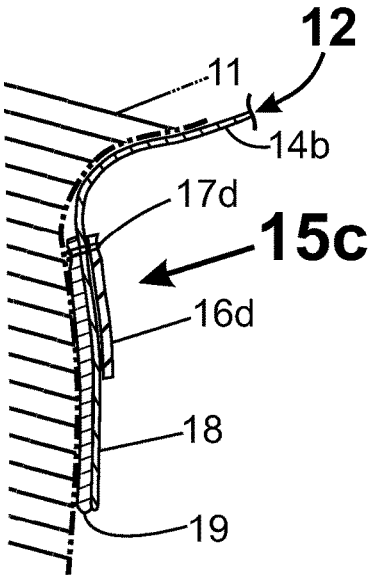
Figure 2B:
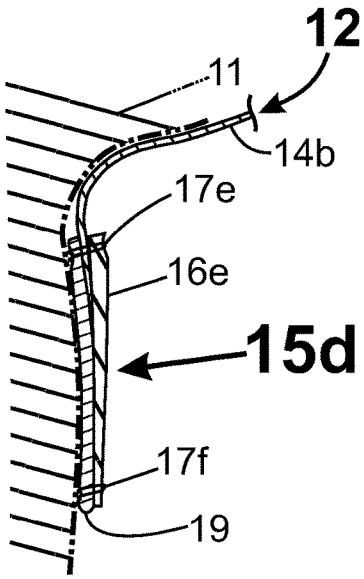
Figure 2C:
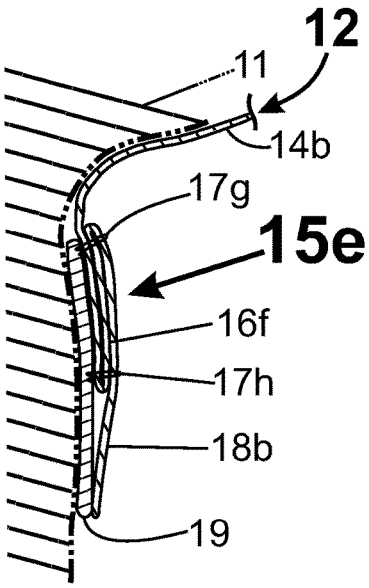
Figure 2D:
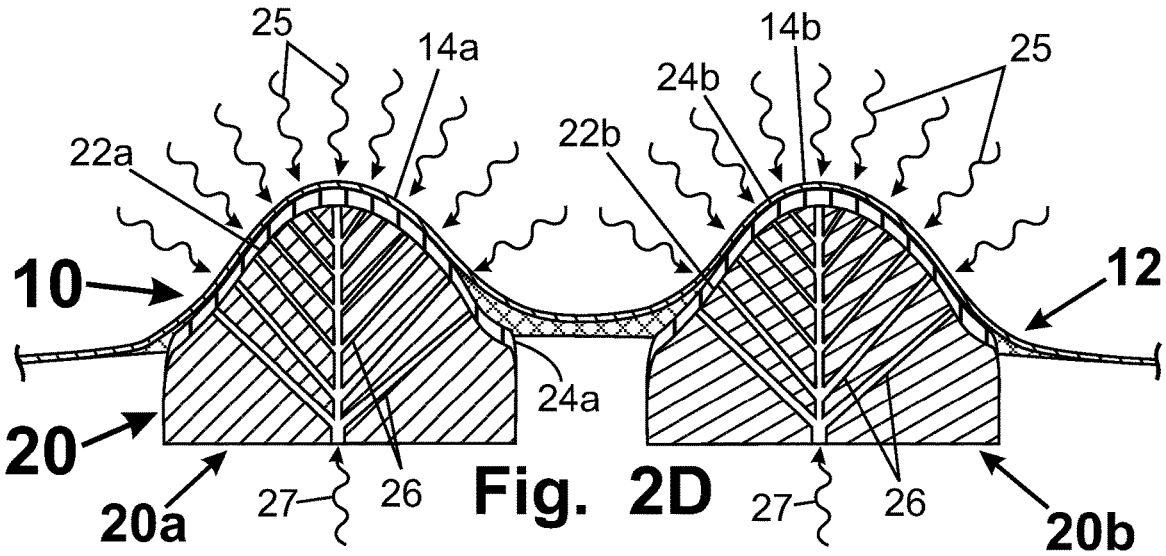
Figure 2E:
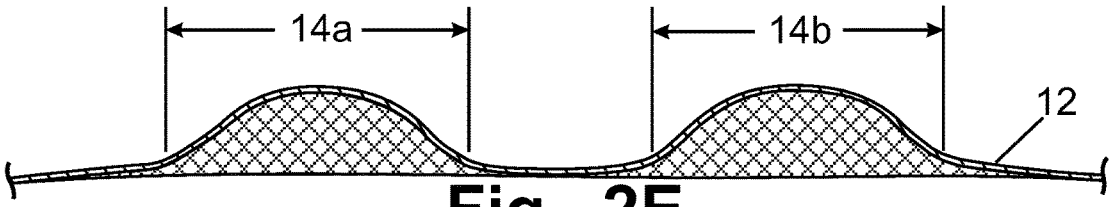
Figure 3A:
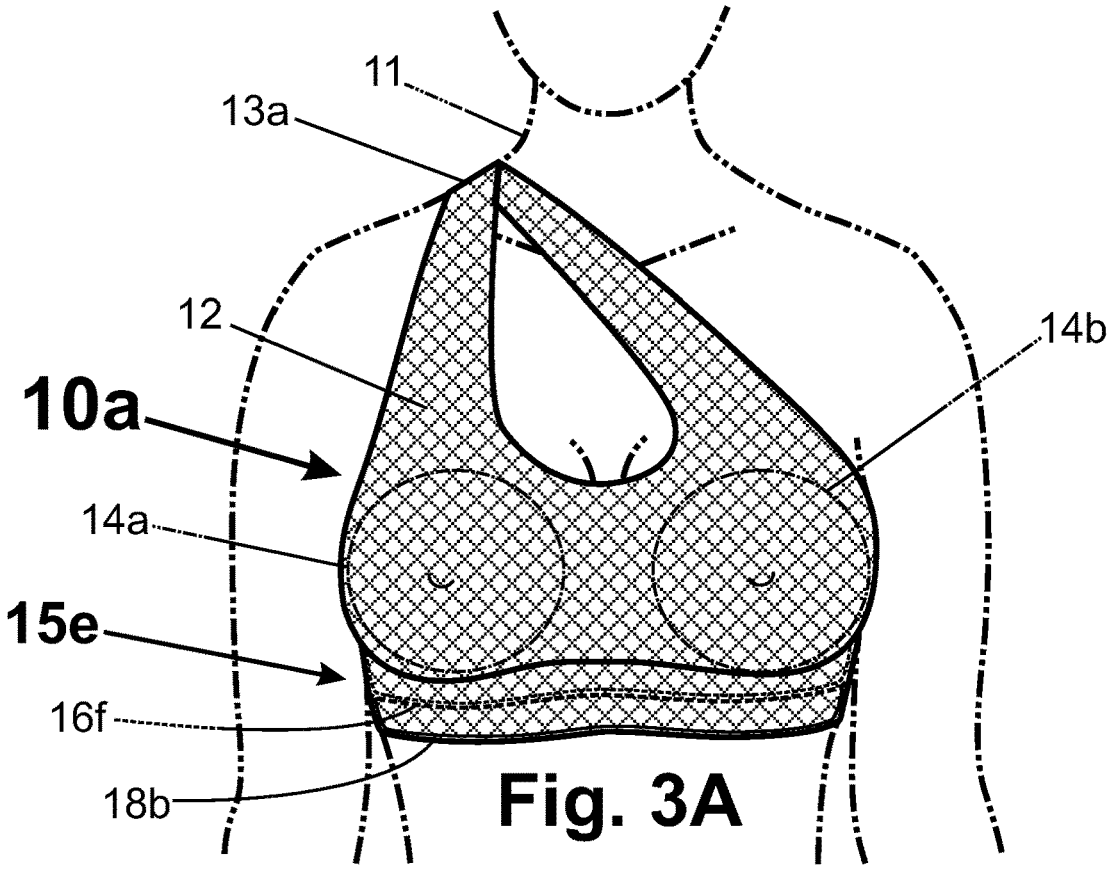
Figure 3B:
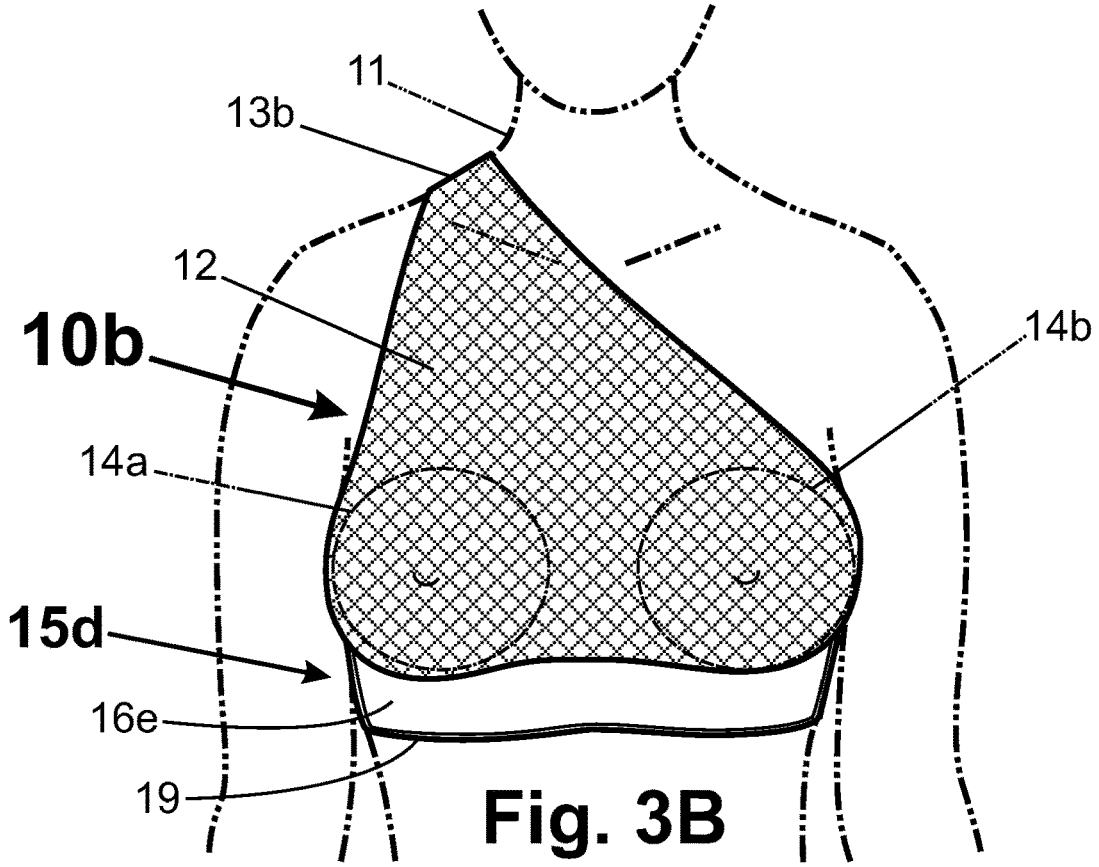
Figure 4:
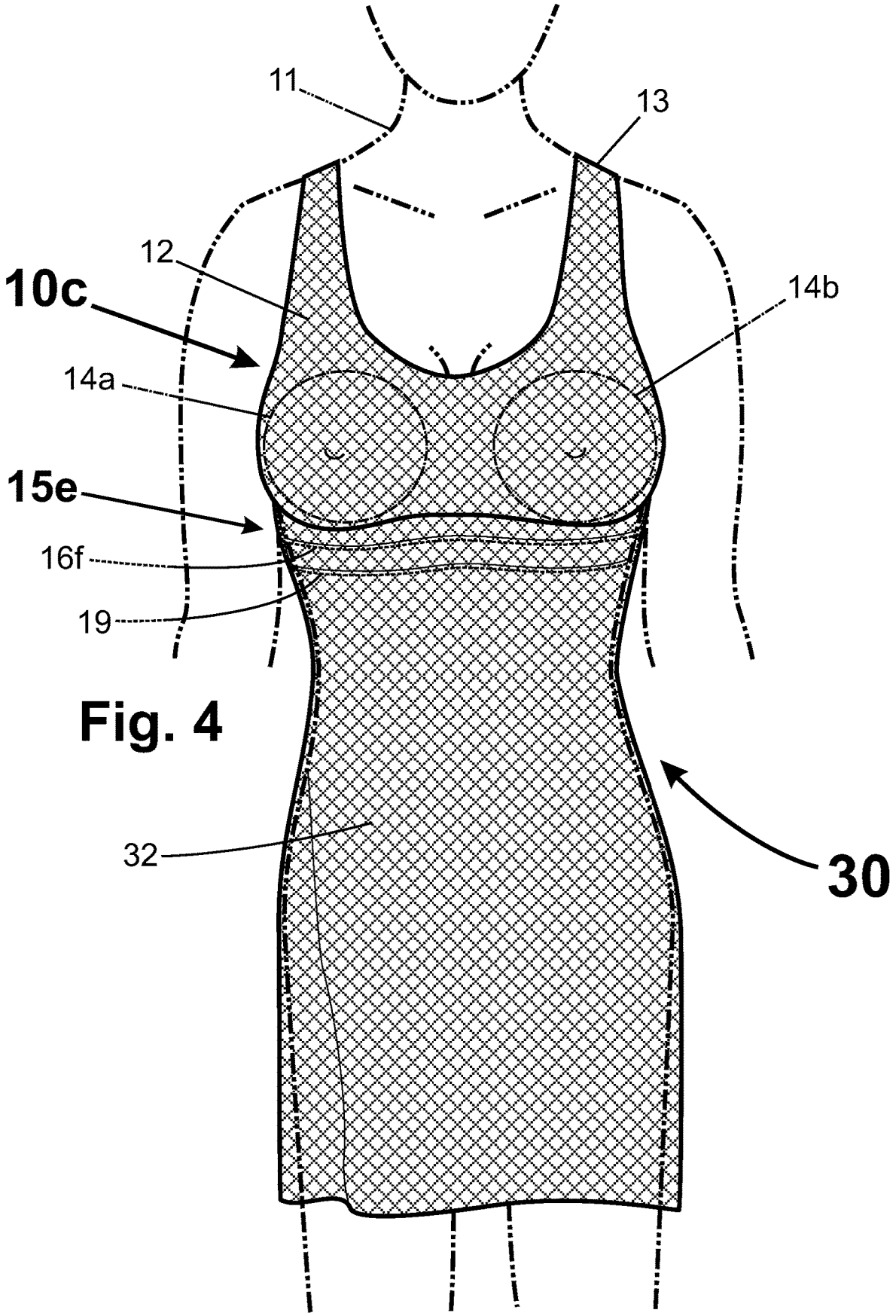
Figure 5:
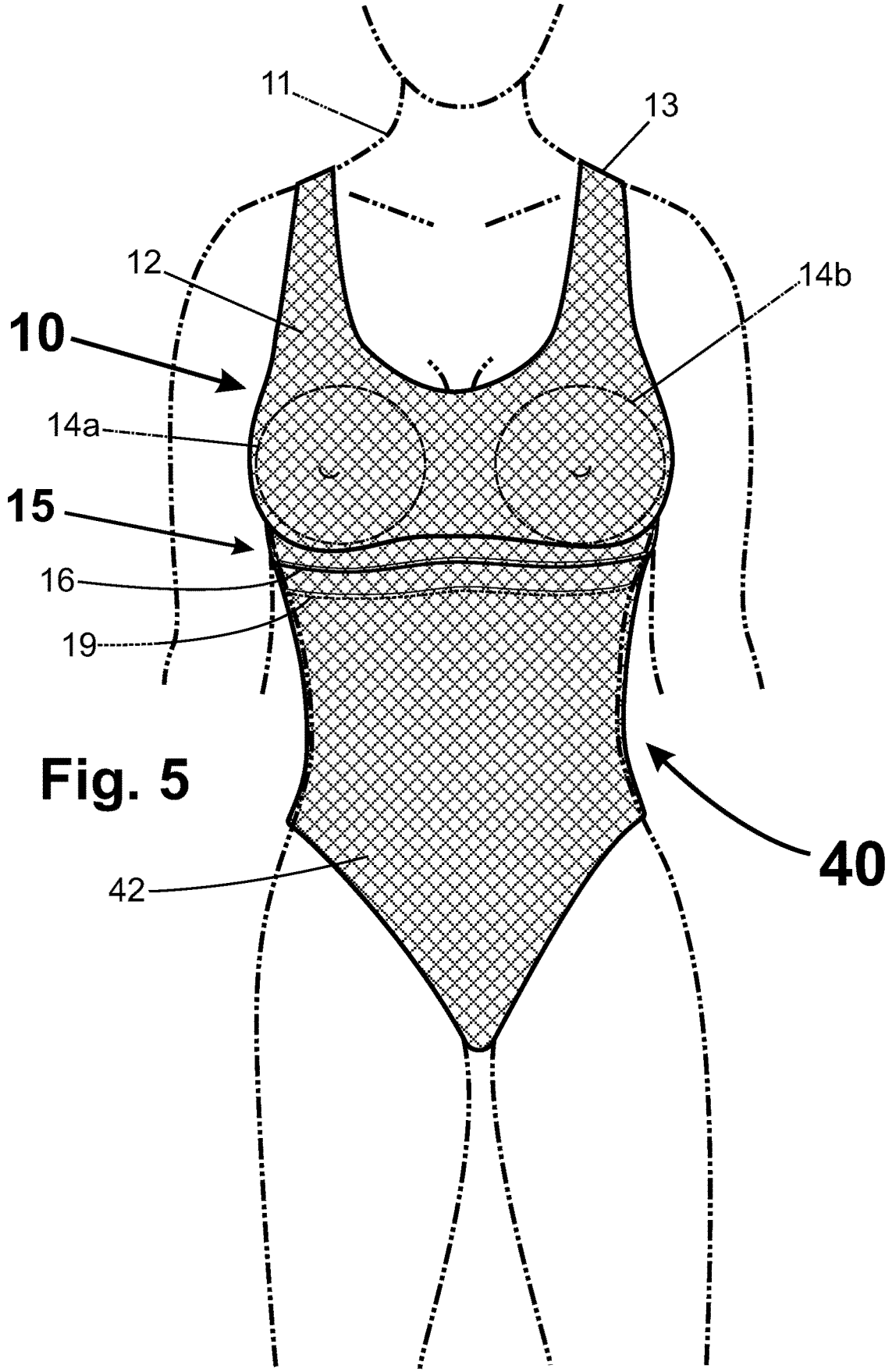

FIG. 1B Side section view of variable elastic under band 15—Pleated elastic fabric FIG. 1C Side section view of variable elastic under band 15*a*—2 pleats of elastic fabric FIG. 1D Side section view of variable elastic under band 15*b*—2 overlapped pleats FIG. 2A Side section view of variable elastic under band 15*c*—Separate elastic FIG. 2B Side section view of variable elastic under band 15*d*—Tapered elastic FIG. 2C Side section view of variable elastic under band 15*e*—Hidden pleat FIG. 2D Section view of Bungee bra 10 during manufacturing FIG. 2E Section view of Bungee bra 10 after manufacturing FIG. 3A Front perspective view of a two-strap single-shoulder bungee bra FIG. 3B Front perspective view of a single-strap single-shoulder bungee bra FIG. 4 Front perspective view of a dress incorporating a bungee bra FIG. 5 Front perspective view of a one-piece swimming suit incorporating a bungee bra

DRAWING REFERENCE NUMBERS

10 Bungee bra (example 1-dual-strap)
10a Bungee bra (example 2-crossover strap)
10b Bungee bra (example 3-single-strap)
11 User (person)
12 Elastic fabric
13 Shoulder strap
13a-b alternative shoulder strap designs
14a-b relaxed elastic zones
15 Variable elastic under band (example 1) (Pleated under band)
15a-b Variable elastic under band (example 2&3) (Double pleated under band)
15c Variable elastic under band (example 4) (Elastic under band)
15d Variable elastic under band (example 5) (Tapered under band)
15e Variable elastic under band (example 6) (Hidden-pleat elastic band)
16a-b Pleated upper bands
16 Upper band-elastic fabric pleat
16c Pleated upper band-middle band
16d Elastic band
16e Tapered elastic band
16f Hidden-pleated upper elastic band
17 Sewn seam (stitching)
17a-h Sewn seams (stitching)
18 Lower band (lower portion of elastic fabric)
18a Lower band (lower portion of elastic fabric)
18b Lower band (elastic fabric covers upper band)
19 Soft padding
20 Thermal treatment system
20a-b Shaping molds for Fabric relaxation zones 14a-b respectively.
22a-b Molding surfaces on Forming molds 20a-b respectively.
25 External heat source-hot air, steam, optical-thermal, infrared, thermal contact, etc.
27 Internal heat source-hot air, steam, thermal contact, etc.
32 Lower portion of dress 30

-continued

| DRAWING REFERENCE NUMBERS | |
|---|---|
| 24a-b Porous insulating layers (insulating layers) | 42 Lower portion of swim suit 40 |
| 26 Plurality of internal passageways | |
| Heating tubes (for steam, hot air, etc.) | |
| 30 Dress with built-in Bungee Bra | |
| 40 Swimsuit with built-in Bungee Bra | |

DETAILED DESCRIPTION OF THE INVENTION

The present disclosure is related to support bras, and more particularly, to support bras designed for larger breasted women to provide comfortable and secure support during active sports.

FIG. 1A is a perspective illustration of a bungee bra 10 example designed for a user 11 (i.e., person), according to one or more embodiments of the present disclosure. The bungee bra 10, can comprise an elastic fabric 12 that is cut and sewn into a sports bra and a variable clastic under band 15 that extends around the bottom circumference of the bungee bra 10. The clastic fabric 12 is illustrated with a crisscross pattern so it can be seen by the reader. The elastic fabric 12 can comprise a single layer of elastic fabric or comprise two or more layers of elastic fabric that are sewn or folded together at their edges as is common in the sports bra industry. The variable clastic under band 15 can comprise a pleated structure that can be formed from the elastic fabric 12. In some embodiments the entire support bra can be formed from a single cut sheet of elastic fabric 12. The elastic fabric 12 can comprise a knitted fabric with an elastic portion and a yarn portion knitted together to form a thin stretchable fabric (e.g., spandex). The elastic portion can comprise nearly any elastic polymer (e.g., a natural rubber, a TPU, a SEBS, an EPDM, a TPR, a silicone elastomer, a fluoroelastomer, a neoprene, etc.), while the yarn portion can comprise nearly any textile yarn (e.g., a nylon yarn, a polyester yarn, a polypropylene yarn, etc.). The elastic portion can comprise elastic cords woven or knitted into the elastic fabric 12 and/or an elastic polymer layer bonded to the exterior of a knitted fabric. The variable elastic under band 15 can be constructed with a different elastic fabric than the clastic fabric 12.

The bungee bra 10 can comprise a front panel made of the elastic fabric 12 and extends from one side of the user 11 to the other (alternate front panels see in FIGS. 3A, 3B, 4 and 5). This front panel can be made of a single piece of elastic fabric to insure there is a smooth and seam-free surface for supporting the breasts. Each of the example bungee bras disclosed here (i.e., bungee bras 10, 10*a*, 10*b* and 10*c*) can be constructed with a seamless front panel and a back panel that are bonded (i.e., sewing, gluing, etc.) at their edges under the user's armpits. This front panel can be modified to comprise two relaxed clastic zones 14*a* and 14*b* without requiring seams or other hard structures. The two relaxed elastic zones 14*a* and 14*b* are each designed for holding the right and left breasts respectively of the user 11. The two relaxed elastic zones 14*a* and 14*b* (hereafter "relaxed elastic zones 14*a* and 14*b*") are also located at what is considered the breast cups for the bra. The front portion of the elastic fabric 12 is shown in FIG. 1A and can have a corresponding back portion of similar elastic fabric for the back panel of bungee bra 10. In some embodiments the back portion of bungee bra 10 can be made from a separate sheet of clastic fabric that is similar to the elastic fabric 12. In other embodiments, the back portion of bungee bra 10 can be formed with the same sheet of the elastic fabric 12 that comprises the front panel of the bungee bra 10. The back portion can be cut and constructed to have any number of textile patterns and strap designs common to the back portions of prior art sports bras. In some embodiments, a pair of shoulder straps 13 (hereafter "shoulder straps 13") can be seamless and connect the front and back portions of the bungee bra 10 as a single piece of the clastic fabric 12 that is then sewn together on the sides to form the bra structure. In other embodiments, the shoulder straps can connect at the top to corresponding straps on the back panel (hidden by user). In some embodiments, the elastic fabric 12 can comprise one or more layers of elastic fabric to provide the desired compression and support for the particular bungee bra being made. The number of clastic fabric layers used for the clastic fabric 12 can be determined by the desired level of support and the elasticity of the clastic fabric 12. In some embodiments, the bungee bra 10 can comprise a separate front and back panel similar to the visible portion of the elastic fabric 12 and can be sewn together at the top of the shoulder straps 13 and on the sides under the user's arms. While sewing will often be used as the example for bonding various elastic fabric panels and elastic elements together in this paper, the reader should understand that other bonding means can be substituted, and several other bonding methods are commonly used by the textile industry, including but not limited to, thermal bonding, adhesives, glues, rivets, clasps, zippers, etc.

As illustrated in FIGS. 1A and 1B, the variable elastic under band 15 (hereafter "pleated under band 15") includes a pleated upper band 16, a lower band 18 and a band of soft padding 19 (hereafter "soft padding 19"). All three of these structures can extend completely around the bottom edge of the bungee bra 10 to form a complete loop of elastic fabric (i.e., upper and lower bands 16 and 18) and soft padding 19 around the user while being worn. In this way, the pleated under band 15 can grip the user's chest and provide support under the breasts. The pleated upper band 16 and lower band 18 can be a pleated section of the elastic fabric 12 that wraps around the circumference of the bungee bra 10. In other embodiments, the pleated upper band 16 and lower band 18 can be formed from a separate sheet(s) or panel(s) of elastic fabric (i.e., similar to clastic fabric 12). Notice that the crisscross pattern is shown on the pleated upper band 16 and the lower band 18 to illustrate to the user what a bungee bra might look like if constructed from a single sheet of elastic fabric 12. In other embodiments, the pleated upper band 16 and lower band 18 can be constructed from a different elastic fabric with a different color pattern to provide a particular two tone look to distinguish the pleated under band 15 structure from the main body of the elastic fabric 12. In some embodiments, the entire bungee bra can be made from just a single piece of the elastic fabric 12 which has been sewn or otherwise bonded at its side edges to form both the body of the bra and the pleated under band 15 (i.e., soft padding 19 not used). The pleated upper band 16 can be formed by sewing together a flap of the elastic fabric 12 such that the flap forms a pleat of the elastic fabric 12 that rests on top of the lower band 18 (see side section view in FIG. 1B). The lower band 18 can comprise a bottom portion of the elastic fabric 12 that is bonded (i.e., sewn) to the soft padding 19. The soft padding 19 can be optional and the pleated under band 15 can comprise only pleats in the elastic fabric 12 (see FIGS. 1B through 1D, with soft padding 19 omitted). The soft padding 19 can be a plush cotton pad or fabric designed for contact with the user's skin and stretch with the upper and lower bands 16 and 18. The soft padding 19 can extend completely around the bottom periphery of the bungee bra 10. In some embodiments, the soft padding 19 can comprise a thick elastic fabric. In this example, the soft padding 19 completely covers the underside of the pleated under band 15. In other embodiments, the soft padding 19 can include an additional elastic fabric or an elastic strip to further add to the elastic tension created by the elastic fabric 12 within the upper and lower bands 16 and 18 respectively. In the illustrated embodiment in FIGS. 1A and 1B, the lower band 18 comprises a lower portion of the elastic fabric 12. In other embodiments, the pleated upper band 16 and/or lower band 18 can comprise separate elastic bands that are distinct from the elastic fabric 12 (see FIGS. 2A and 2B). In each of these examples, the construction of the under band defines a larger elastic coefficient (i.e., a larger tension during use) at its upper portion than at its lower portion. For pleated under band 15, this means the pleated upper band 16 provides a greater elastic strength and the lower portion of lower band 18 provides a weaker elastic strength.

In the embodiment disclosed in FIGS. 1A and 1B, the pleated upper band 16 provides added elastic force onto the upper portion of the lower band 18 to provide greater elastic force at the top half of the pleated under band 15 than at the bottom half. By decreasing the elastic strength from top to bottom the problem of the under band rolling up is greatly reduced. Additionally, because the pleated upper band 16 is not directly attached to the surface of the lower band 18 (i.e., except at the top edge of the lower band 18), the under band structure can be much more flexible and comfortable for the user while also providing a greatly reduced chance of the pleated under band 15 rolling up on the user during use. Thus, the pleated structure of the pleated upper band 16 is designed to provide greater elastic force (i.e., a larger spring constant "elastic constant") near the top of pleated under band 15 than the at bottom part to help stabilize the lower band 18 from curling or rolling-up during strenuous sports activities. The added elasticity at the top of the pleated under band 15 provides the benefit that it becomes nearly impossible for the breasts to slip down and bulge pass the pleated under band 15 which provides greater support without putting pressure on the breasts.

FIG. 1B illustrates a side section view of the pleated under band 15. The elastic fabric 12 can be seen in FIG. 1B extending from a bottom portion of its relaxed elastic zone 14*b* and into the pleated under band 15. The elastic fabric 12 can be pleated by sewing a flap in the elastic fabric 12 with a sewn seam 17 to create the pleated upper band 16. In other embodiments, additional pleats can be added by simply sewing additional flaps into the elastic fabric 12 (see FIGS. 1C and 1D). In some embodiments, the pleated under band 15 can comprise multiple pleats to create a particular cosmetic look. As mentioned before, the soft padding 19 can be omitted and the elastic fabric 12 with one or more pleats can be used to form a pleated under band similar to the pleated under band 15. Additional pleats can have similar construction to the pleated upper band 16 and be overlapped with varying or similar amounts of overlap between each of the pleated flaps. In some embodiments, the soft padding 19 can comprise a plush elastic fabric that is sewn, or otherwise bonded, to the inside of the elastic fabric 12 that is forming the lower band 18. In other embodiments, the soft padding 19 can be glued to the inside surface of the lower band 18. In other embodiments, the soft padding 19 can be thermally bonded to the inside surface of the elastic fabric 12. Alternatively, the sewn seam 17 (i.e., stitching) can also attach the soft padding 19 to the pleated upper band 16 by going through both the elastic fabric 12 and soft padding 19 near the top of the pleated under band 15. In other embodiments, the pleated upper band 16 can be formed by thermally bonding the elastic fabric 12 to itself along the scam path of sewn scam 17. To provide added support and stability and comfort to the pleated under band 15, the width of the pleated under band 15 (i.e., the top to bottom distance) can be made larger or smaller as needed to provide the proper surface area in contact with the user's skin and/or to provide the proper holding force from the elastic nature of the pleated under band. In FIGS. 1C, 1D, 2A, 2B and 2C we will look at five more examples of alternative constructions for a variable elastic under band that could be substituted for the pleated under band 15 seen in FIGS. 1A and 1B. In each of these examples, the section view direction and position will be the same as for pleated under band 15 seen in FIG. 1B.

During construction, many different manufacturing procedures can be used to make the disclosed bungee bras. Further, multiple ways exist for assembling an upper band (e.g., upper band 16 and 16*a-f*), a lower band (e.g., upper band 18, 18*a* and 18*b*), a main body of the bra (e.g., elastic fabric 12) and/or any additional panels (e.g., soft padding 19). In alternate embodiments, these upper bands and lower bands can be assembled (e.g., sewn together) separately to form a long strip of under band material on a roll. Later this long strip of material can be cut and sewn onto the bottom of the elastic fabric 12 to provide the under band for a particular bungee bra. The optional soft padding 19 can be added as a final step of assembly if desired. In other alternative embodiments, the soft padding 19 might be further included in the long strip of under band material mentioned above, to be later sewn onto the bottom of the elastic fabric 12 portion of the bungee bra 10. Such prefabrication of the under band can be used with nearly any under band design, including the herein disclosed under bands 15 and 15*a-e*.

FIG. 1C illustrates a side section view of a variable elastic under band 15*a* (hereafter "pleated under band 15*a*") from the same section view direction (see FIG. 1A) as pleated under band 15 in FIG. 1B. The pleated under band 15*a* can comprise two pleated upper bands 16*a* and 16*b* formed by a sewn scam 17*a* and 17*b* respectively and a lower band 18*a* comprising a lower portion of the elastic fabric 12 bonded to the soft padding 19 (i.e., by sewn seams 17*a-b* or other bonding means). In this embodiment, the sewn scams 17*a* and 17*b* can attach the soft padding 19 to the two pleated upper bands 16*a* and 16*b* respectively. In other embodiments, the sewn seams 17*a* and 17*b* can be replaced with other bonding methods, including but not limited to, thermal bonding, adhesive bonding and gluing. The amount of overlap between the two pleated upper bands 16*a* and 16*b* and the lower band 18*a* can be adjusted during manufacturing to accommodate a particular need of the user. Note that the lower band 18*a* only extends partially across the width (i.e., top to bottom edge distance) of the pleated under band 15*a*, while the lower band 18, seen in FIG. 1B, extended the full width of the pleated under band 15. The overlapping nature of the pleated upper bands 16*a* and 16*b* and lower band 18*a* result in an elastic coefficient that changes along the width of the pleated under band 15*a*, with a significantly greater elastic coefficient at the top (i.e., three layers of the elastic fabric 12) than at the bottom (i.e., one layer of the elastic fabric 12). The pleated under band 15*a* also demonstrates that the elastic coefficient, in some embodiments, can be greatest at a midpoint across its width, where the greatest elastic tension might be at the middle of the pleated under band 15*a* where there are five layers of the clastic fabric 12 stacked atop one another (i.e., 2-layers from pleated upper band 16*a*, 2-layers from pleated upper band 16*b* and 1-layer from lower band 18*a*).

FIG. 1D illustrates a side section view of a variable clastic under band 15*b* (hereafter "pleated under band 15*b*") from the same section view direction (see FIG. 1A) as pleated under band 15 in FIG. 1B. The pleated under band 15*b* can comprise two pleated upper bands 16*a* and 16*c* formed with a sewn seam 17*c* at the top of the pleated under band 15*b*. Pleated upper band 16*a* can have the same structure as pleated upper band 16 or 16*a* seen in FIGS. 1B and 1C respectively. The lower band 18 can comprise a single layer of the elastic fabric 12 and in this example would rest directly on the user's skin during use. Both pleated upper bands 16*a* and 16*c* extend back to the sewn seam 17*c* and can both be attached in place by the sewn seam 17*c*. This provides the pleated under band 15*b* with its greatest clastic tension at the top and slowly decreases in steps toward the bottom of the lower band 18. Notice that the pleated upper band 16*c* is positioned between the pleated upper band 16*a* and lower band 18, making it somewhat of a pleated middle band. The soft padding 19 is omitted in this example, but can easily be added to the underside of the lower band 18, if desired. One advantage to adding the soft padding 19 to the underside of the lower band 18 is that it would help control the rolling up of the lower band 18 while the bungee bra was being put-on and during use. In other embodiments, this rolling up of the lower band 18 can be reduced by stitching the lower end of pleated upper band 16*c* to the lower band 18. However, this could tend to make the pleated under band 15*b* slightly less comfortable for the user. With this multiple pleated structure, the bottom portion of the lower band 18 is stabilized and resists rolling up. In other embodiments, the elastic fabric 12 can be extended at the bottom of the lower band 18 so that it wraps under and behind the existing lower band 18 and extends back to the sewn seam 17*c* for attachment and form a third pleated band (i.e., a pleated lower band). FIG. 1D illustrates how the sewn seam 17*e* can attach all five layers of the clastic fabric 12 in the pleated under band 15*b*, two layers each for the pleated upper bands 16*a* and 16*c*, and a single layer for the lower band 18. In other embodiments, the sewn seam 17*c* might be sewn through only four layers comprising the upper portions of the pleated upper bands 16*a* and 16*c*, making it relatively easy for the user to fold the lower band 18 upward inside the bungee bra for added support under the breasts. In other embodiments, the bottom edge of the pleated upper band 16*c* can be sewn to the lower band 18 to help maintain the position of the lower band 18 while dressing.

FIG. 2A illustrates a side section view of a variable elastic under band 15*c* (hereafter "segmented under band 15*c*") viewed from the same section view direction (see FIG. 1A) as pleated under band 15 in FIG. 1B. The segmented under band 15*c* can comprise an elastic upper band 16*d* (hereafter "elastic band 16*d*") and the previously discussed lower band 18 (i.e., lower portion of fabric 12) and the soft padding 19. The elastic band 16*d* can comprise nearly any elastic polymer material that can be stretched to greater than 125% of its natural length and may include a stretchable fabric cover in its construction for cosmetic purposes. The elastic band 16*d* can be a thin strip of an elastic polymer that covers approximately the upper portion of the segmented under band 15*c*. The clastic coefficient of the elastic band 16*d* adds to the clastic coefficient of the elastic fabric 12 below it to provide a larger elastic coefficient at the upper portion of the segmented under band 15*c* than at its lower portion. A sewn seam 17*d* can be stitched along the top edge of the elastic band 16*d* to attach the elastic band 16*d* to the lower band 18 and soft padding 19. In some embodiments, the underside of the elastic band 16*d* may also be bonded directly to the elastic fabric 12. In other embodiments, the elastic band 16*d* can be sewn at the top and bottom with stitching similar to the sewn scam 17*d*. In other embodiments, the elastic band 16*d* can be sewn under the clastic fabric 12 in substantially the same location on top of soft padding 19 with the sewn seam 17*d*. In alternate embodiments, the clastic band 16*d* can be replaced with a pre-formed pleat of an elastic material (i.e., similar to upper band 16) and sewn into the segmented under band 15*c* in a similar manner.

FIG. 2B illustrates a side section view of a variable elastic under band 15*d* (hereafter "tapered under band 15*d*") viewed from the same section view direction (see FIG. 1A) as pleated under band 15 in FIG. 1B. The tapered under band 15*d* can comprise the soft padding 19, the bottom portion of the clastic fabric 12, a tapered elastic band 16*e* and a sewn seam 17*e*. The soft padding 19 can be held in place against the tapered elastic band 16*e* with the sewn scam 17*e* (hereafter "stitching 17*e*") at the top and a sewn scam 17*f* (hereafter "stitching 17*f*") at the bottom. As illustrated, the clastic fabric 12 need only extend partially under the tapered elastic band 16*e* and can be held in place by the stitching 17*e*. In some embodiments, the clastic fabric 12 can extend across the exterior of the tapered elastic band 16*e* to provide a matching color pattern for the tapered under band 15*d*. The clastic bands 16*d* and 16*e* can be made from nearly any elastic polymer, including but not limited to, natural rubber, Butyl, EPDM (Ethylene Propylene Diene Monomer), SEBS (Styrene-Ethylene-Butylene-Styrene), TPU (ThermalPlastic polyUrethane), TPR (Thermal Plastic Rubber), silicone elastomers, fluoroelastomers, Neoprene, Nitrile and many other elastomers. In this particular example, the tapered elastic band 16*e* is held securely in place at both its top and bottom by the stitching 17*e* and 17*f* respectively. Because the upper portion of the tapered elastic band 16*e* is thicker than its lower portion, the tapered clastic band 16*e* will tend to have a larger elastic coefficient at its upper portion than at its lower portion. Thus, the tapered elastic band 16*e* can provide the tapered under band 15*d* with a variable elastic coefficient that decreases slowly from top to bottom. In an alternative embodiment, the elastic fabric 12 can be extended to the bottom of soft padding 19 and be sewn in place between the soft padding 19 and tapered elastic band 16*e* with stitching 17*e* and 17*f*. In other embodiments, the soft padding 19, the elastic fabric 12 and tapered elastic band 16*e* can be bonded together using a glue or an adhesive which allows the stitching 17*e* and 17*f* to be omitted. In one embodiment of the invention, the elastic fabric 12 can be extended to cover the tapered elastic band 16*e* and then sewn into place with stitching 17*e* and 17*f* at their present location in FIG. 2B so that the clastic fabric 12 forms a continuous exterior fabric panel from the shoulder straps 13 to the bottom of this modified clastic under band (i.e., elastic fabric 12 positioned on the exterior of the tapered elastic band 16*e*). In alternate embodiments, the tapered elastic band 16*e* can be replaced with a pre-formed double-pleat of an elastic material (e.g., similar to pleats 16*a*, 16*b* and lower band 18 in under band 15*b*) and sewn into under band 15*d* in a similar manner. In other alternative embodiments, the clastic fabric 12 seen in FIGS. 2A and 2B can be wrap over the exterior of the elastic bands 16*d* and 16*e* respectively to hide the elastic bands from view with the lower end of the elastic fabric 12 optionally folded under the elastic bands 16*d-e* and in between it and the soft padding 19.

FIG. 2C illustrates a side section view of a variable elastic under band 15*e* (hereafter "hidden pleat under band 15*e*") viewed from the same section view direction (see FIG. 1A) as pleated under band 15 in FIG. 1B. The hidden-pleat under band 15*e* can comprise the optional soft padding 19, a hidden-pleat upper band 16*f* (hereafter "pleated upper band 16*f*") and an outer band 18*b* each constructed from the elastic fabric 12. The pleated upper band 16*f* and outer band 18*b* can be sewn into place with a sewn seam 17*g* at the top and a sewn seam 17*h* at the bottom of pleated upper band 16*f*. The greater number of layers of elastic fabric at the top of hidden-pleat under band 15*e* (i.e., three layers) than at the bottom (i.e., one layer) provides a larger elastic coefficient at the top than the bottom. This arrangement provides a smoother exterior to the hidden-pleat under band 15*e* with the pleated structure (i.e., pleated upper band 16*f*) substantially hidden by the bottom portion of the elastic fabric 12. As with all the example under bands disclosed here, the hidden-pleat under band 15*e* can be constructed from a separate sheet of elastic fabric that can be different from the elastic fabric 12. Further, other bonding methods discussed herein can be used to replace the sewn seams. While not specifically illustrated in FIGS. 1B through 2C, it is very common in the construction of sports bras and support bras to attach the under band to the upper portion of the bra with a seam near the top of the under band for case of assembly. Thus, the elastic fabric 12 need not directly continue into the disclosed under bands 15 and 15*a-e* as illustrated, but instead can be connected with a sewn scam or other bonding means near the top portion of the under band (e.g., top of soft padding 19). This allows under bands 15 and 15*a-e* to be constructed separately from the main body of the bra (i.e., upper portion of bra) and later easily installed. Thus, many combinations of pleated bands, elastic bands and comfort components can be combined in many ways to produce a variable elastic under band. Furthermore, the bottom edge of the elastic fabric 12 can comprise a fold, as is common, near the bottom of the under band (e.g., under bands 15 and 15*a-e*) to provide a cleaner look to the under band.

FIG. 2D illustrates a top section view of the bungee bra 10 stretched onto a thermal treatment system 20 as an example manufacturing process for the bungee bra. The thermal treatment system 20 can comprise two shaping molds 20*a* and 20*b* which can comprise a molding surface 22*a* and 22*b* respectively and a porous insulating layer 24*a* and 24*b* respectively. The two shaping molds 20*a* and 20*b* can include a plurality of internal passageways 26 for directing steam, hot air or other heated fluid to the relaxed elastic zones 14*a* and 14*b*. During operation, the thermal treatment system 20 can stretch the elastic fabric 12 of the bungee bra 10 over the two shaping molds 20*a* and 20*b* and then heat the relaxed elastic zones 14*a* and 14*b* with either an external heat source 25 and/or from an internal heat source 27. The internal heat source 27 can flow through the plurality of internal passageways 26. These heat sources 25 and 27 are designed to heat a portion of the elastic fabric 12 to a desired temperature to relax the tension in the elastic portion of the elastic fabric 12 to permanently deform the elastic fabric 12 in the relaxed elastic zones 14*a* and 14*b* without damaging the yarn fabric or elastic portions (i.e., without damaging the elastic fabric 12). The external heat source 25 can comprise nearly any commercial heating process, including but not limited to, hot air, steam, photothermal light, infrared, and thermal contact. Most heating methods for the external heat source 25 can be non-contact or low-contact heat sources (i.e., hot air, steam, infrared, etc.). However, for thermal contact heating, a top heated mold (not shown) with a matching surface shaped to fit against the molding surfaces 22*a* and 22*b*, or porous insulating layers 24*a* and 24*b*, can be moved into contact with the relaxed elastic zones 14*a* and 14*b* on the elastic fabric 12 to conduct heat directly into the elastic fabric 12. The porous insulating layers 24*a* and 24*b* (hereafter "insulating layers 24*a* and 24*b*") would allow quicker heating of the elastic fabric 12 and also allow movement of the elastic fabric 12 to make better contact with such a heated mold.

The internal heat source 27 can comprise nearly any fluid that can pass through the plurality of internal passageways 26, including but not limited to, hot air, steam, other gasses, etc. The temperature of these fluids would be selected to provide the desired amount relaxation (i.e., deformation) of the elastic portion of elastic fabric 12. In one embodiment, the internal heat source 27 can be high-temperature steam that would flow out through the plurality of internal passageways 26 and disperse through the insulating layers 24*a* and 24*b* to provide controlled heating of the elastic fabric 12. The insulating layers 24*a* and 24*b* can be a cotton fabric where the thermal treatment system 20 could work similar to a dry cleaner station that injects high-temperature steam into the areas that require relaxation of the elastic. In some embodiments, the steam might be injected from the top with a matching upper section opposite the shaping molds 20*a-b*.

The internal heat source 27 may comprise a resistive heater attached to the two shaping molds 20*a* and 20*b*. With such resistive heaters, the shaping molds 20*a* and 20*b* can be made from a thermally conductive metal such as steel or aluminum so that the molding surfaces 22*a* and 22*b* can be easily heated to the desired temperature. With this type of contact heating, the insulating layers 24*a* and 24*b* could be removed so that the elastic fabric 12 can make direct contact with the molding surfaces 22*a* and 22*b*. A specific contact time could be used to cause the desired amount of deformation of the elastic material (i.e., relaxation of elastomer) within the elastic fabric 12. In some embodiments, different temperatures can be used on different portions of the molding surfaces 22*a* and 22*b* can provide different mounts of deformation in the elastic fabric 12 within the relaxed elastic zones 14*a* and 14*b*, respectively.

When stretching the elastic fabric 12 over the shaping molds 20*a* and 20*b*, the amount of stretch is not the same everywhere. Instead, some portions of the elastic fabric 12 are stretched more than others. The thermal treatment system 20 can use a temperature within a specific range that can relax the elastomer used within the elastic fabric 12. The elastomer portions of the elastic fabric 12 will relax more in areas of greater stretch and relax less in areas of less stretch. This can create a variable elasticity within the elastic fabric 12 across the relaxed elastic zones 14*a* and 14*b*, where some portions have been relaxed significantly more than other portions. This variable elasticity can provide a more uniform pressure on the user's breast and provide greater comfort for the same amount of support provided. Also, both the external heat source 25 and internal heat source 27 can provide different temperatures to different portions of the relaxed elastic zones 14*a* and 14*b* to further create this variable elasticity from one portion of the elastic fabric 12 to another. This can give the relaxed elastic zones 14*a* and 14*b* a more even pressure distribution for the user than if a higher temperature was used that caused the elastic to nearly fully melt into the shape of the molding surfaces 22*a* and 22*b*. However, these higher temperatures can weaken the elastic by allowing it to melt and create thin spots in the elastic within the elastic fabric 12 which is not desirable for providing good breast support. Thus, during the heat-treating process, the relaxed elastic zones 14*a* and 14*b* can be stretched significantly beyond their intended final shape so that the heat sources 25 and/or 27 can differentially relax the elastic fabric 12 and the heat treated relaxed elastic zones 14*a* and 14*b* can rebound back to the desired shape after processing (see processed shape in FIG. 2E).

FIG. 2E illustrates a top section view of the bungee bra 10 after the thermal relaxation of the elastic fabric 12 by using the thermal treatment system 20 seen in FIG. 2D. Note that the relaxed elastic zones 14*a* and 14*b* have been permanently deformed by the relaxation of the elastic polymers within the elastic fabric 12. The amount of relaxation across the relaxed elastic zones 14*a* and 14*b* can be greater in some portions of the relaxed elastic zones 14*a* and 14*b* than others to provide a more even pressure on the user's breasts when stretched for use. Thus, the final shape of these relaxed elastic zones 14*a* and 14*b* may be significantly different from the shape of the molding surfaces 22*a* and 22*b*, respectively. Thus, the cavities formed at the relaxed elastic zones 14*a* and 14*b* (see FIG. 2E) can be substantially smaller than the stretched shape formed by the molding surfaces 22*a* and 22*b* during heat treatment (see FIG. 2D). In some embodiments during the heating process, the elastic remained substantially solid enough that the elastomer within the elastic fabric 12 remained elastic to some degree and rebounds to the shape shown in FIG. 2E after removal from the thermal treatment system 20. During production of the bungee bra 10, various sizes of the molding surfaces 22*a* and 22*b* can be used to produce bras with different cup sizes (i.e., for different breast sizes) depending on the user's breast size. In fact, the same bungee bra design with a particular under band size can be used for a wide range of breast sizes by simply selecting the desired amount of relaxation of the elastic within the relaxed elastic zones 14*a* and 14*b*. The amount of relaxation can be controlled by changing the temperature setting on the thermal treatment system 20 and/or changing the size of the molding surfaces 22*a* and 22*b* (i.e., changing the mount that the elastic fabric 12 is stretched during heating). Prototype bungee bras constructed by the Applicants were constructed for breast sizes A through DDD by varying only the amount of stretch of the fabric during heating (i.e., approximately the same air temperature applied to all prototypes). For sizes A and B, no heat treatment was used (i.e., elastic fabric 12 remains flat) and for sizes C through DDD the amount of fabric stretch was progressively increased over the molding surfaces so that the heat treatment would relax the elastic fabric in increasing amounts for the larger cup sizes. This provided a very even pressure around the user's breasts and separated the breasts when worn.

FIG. 3A illustrates a front perspective view of a bungee bra 10*a*. In this example, the bungee bra 10*a* can comprise a construction that is similar to the bungee bra 10, but with a double shoulder strap 13*a* that goes over the same shoulder of the user and an alternative hidden-pleat under band 15*e* (see FIG. 2C). The double shoulder strap 13*a* can be sewn together at the top to keep the two straps together at the top during use. Alternatively, the double shoulder strap 13*a* can comprise separate shoulder straps that are designed to have dual positions: (a) with both straps positioned over one shoulder as shown in FIG. 3A, or (b) the straps separated to fit one strap over each shoulder similar to bungee bra 10 shown in FIG. 1A. In other embodiments, the example variable elastic under bands 15 and 15*a-d* can be substituted for the hidden-pleat under band 15*e*. In some embodiments, the hidden-pleat under band 15*e* can comprise a different elastic fabric than elastic fabric 12 which is used for the upper portion of the bungee bra 10*a*. The hidden-pleat under band 15*e* may also include a different color and/or pattern on its exterior compared to the elastic fabric 12 to provide a desired style or look.

FIG. 3B illustrates a front perspective view of a bungee bra 10*b*. In this example, the bungee bra 10*b* can comprise a construction that is similar to the bungee bra 10, but with a single shoulder strap 13*b* that goes over one shoulder and uses the tapered under band 15*d*. This final example gives the reader a better understanding of how nearly any style of sports bras can be easily adapted to include the bungee bra construction and structure. The reader should also understand that each bungee bra example herein can be effectively used with any of the example variable elastic under band designs (i.e., 15 and 15*a-e*). Furthermore, the bra back panels of the bungee bras are not illustrated in this paper as they are well understood, and because nearly any back panel or back straps design currently found on sports bra and support bras today can be adapted for use with the disclosed bungee bras by someone skilled in the art of bra manufacturing.

FIG. 4 illustrates a front perspective view of a dress 30 with a built-in bungee bra 10*c*. The dress 30 can comprise the bungee bra 10*c* and a skirt portion 32. In some embodiments, the skirt portion 32 can comprise an extension of the elastic fabric 12, where the outer band 18*b* on bungee bra 10*c* (see FIG. 2C) is simply extended to form the skirt portion 32. In this example the bungee bra 10*c* can be constructed as seen in FIG. 2C with the hidden-pleat under band 15*e*. In other designs, the entire dress 30, including bungee bra 10*c* and skirt portion 32, can be constructed from a single sheet of elastic fabric (generally either a single layer or double layer of elastic fabric) cut to the correct shape to be sewn together. If the skirt portion 32 is made from elastic fabric similar to elastic fabric 12, the diameter of the skirt can be tailored to conform the curves of the user or designed to hug the user depending on the desired look. In other embodiments, the elastic fabric could be designed more loose-fitting so that the skirt portion 32 hangs loosely at the bottom. In some embodiments, the skirt portion 32 can be a separate piece of fabric that is attached to the lower portion of the bungee bra 10*c*. In many embodiments, the skirt portion 32 can be made from a standard knitted or woven fabric that is then sewn or otherwise bonded to the bungee bra 10*c*. In some embodiments, the skirt portion 32 can be sewn to the bungee bra 10*c* along the top portion of the hidden-pleat under band 15*e* so as to substantially hide the hidden-pleat under band 15*e* from view. In other embodiments, the skirt portion 32 can be attached over the soft padding 19 and beneath the hidden-pleat under band 15*e* to make a fashion statement with the hidden-pleat under band 15*e* (or other variable elastic under band style) exposed and viewable. Many other configurations and attachments styles are also possible. For example, the hidden-pleat under band 15*e* could be replaced with pleated under band 15 and the skirt portion 32 sewn in place between the soft padding 19 and the lower band 18 of the pleated under band 15 (see FIG. 1B). In other embodiments, the bra portion of bungee bra 10*c* (i.e., portion above under band 15*e*), the hidden-pleat under band 15*e* and the skirt portion 32 of the dress 30 can each be made from different fabrics to provide the desired look for the user. And of course, additional frills and accessories can be added to the plain dress design shown in FIG. 4.

FIG. 5 illustrates a front perspective view of a one-piece swimsuit 40 (hereafter "swimsuit 40") with a built-in bungee bra 10 and lower swimsuit 42. Swimsuit 40, because it will be used in water, may replace the soft padding 19 with a more waterproof padding or remove the soft padding 19 entirely. Because swimsuits are designed to be skintight, the bungee bra 10 and lower swimsuit 42 can all be made from the clastic fabric 12. In some embodiments, the entire swimsuit 40 can be made from a single piece of elastic fabric 12 that is sewn along both sides and the crotch area, or the bungee bra 10 can be used by itself with a bikini bottom. In other embodiments, the swimsuit 40 might be constructed from two pieces of elastic fabric 12 (i.e., front side and back side) that are sewn along both sides, the crotch area and at the top of the shoulder straps 13. The pleated under band 15 can be sewn in after the general body of the swimsuit 40 is sewn together. As with all bungee bra examples disclosed herein, the type and style of shoulder strap(s) is at the discretion of the designer. In some designs, the bungee bra 10, pleated upper band 16 and/or lower swimsuit 42 can each be made from different fabrics than the bra portion of the bungee bra 10 to provide a particular look to the swimsuit. More complex patterns of sewn sections can also be used to provide additional styling preferences for the user without straying from the disclosed variable elastic under band technology and/or the relaxed elastic cup area areas (i.e., relaxed elastic zones 14*a-b*) found in the disclosed bungee bra invention.

OPERATIONAL DESCRIPTION

All the embodiments presented herein for the bungee bra operate with substantially the same parameters for the user as prior art sports bras. However, the discussed examples of the bungee bra do have operational characteristics that are different from the prior art, but are accessed automatically without user intervention. First, the variable elastic under bands 15, 15*a*, 15*b*, 15*c*, 15*d* and 15*e* have properties that provide a larger clastic coefficient on the upper portion of their under bands just below the breasts to provide a firm closure and prevent the breasts from slipping pass the under band. Second, the variable elastic under bands 15, 15*a*, 15*b*, 15*c*, 15*d* and 15*e* have a decreasing thickness and/or decreasing elastic coefficient going from top to bottom which helps prevent the under band from rolling up on the user (a major problem for nearly all sports bras). Third, the cup areas of the bungee bra (i.e., relaxed elastic zones 14*a* and 14*b*) have a smooth variation in the relaxation of the clastic fabric to provide separation of the breasts, even and comfortable pressure on the breasts and secure support for the breasts (i.e., greatly reduces slipping and bulging).

Various prior art bra structures such as back strap designs, side designs, shoulder strap design, zippers, decorative add-ons, and other structures can be used in combination with the disclosed bungee bra embodiments and still provide the disclosed advantages of the bungee bra. For example, a common type of back panel for sports bras is a "racerback" style or layout, which can be easily integrated into the illustrated front panels of the bungee bras with two straps (i.e., 10 and 10*c*) simply by using the appropriate "racerback" back panel layout sewing it to the front panel to form the bungee bra. Note that many other front and back panel designs are also available in the prior art that can incorporate the variable elastic under bands 15, 15*a*, 15*b*, 15*c*, 15*d* and 15*e* and/or the relaxed elastic zones 14*a* and 14*b*. This is because the variable elastic under bands 15, 15*a*, 15*b*, 15*c*, 15*d* and 15*e* can simply be added to the bottom circumference of nearly any prior art support bra or sports bra. Also note that the back panel design might need to be appropriately modified to match up with the front panel used. Something a bra designer could easily do. For example, single shoulder strap front panels may require appropriate back panels from prior art for that class of bra. Thus, nearly all back panel bra designs and nearly all prior art bra designs can be easily adapted to include the disclosed bungee bra technology by someone skilled in clothing design.

RAMIFICATIONS AND SCOPE

These example configurations disclosed for the bungee bra provides the reader examples of possible configurations, and many additional permutations that are easily attainable by simply changing the width, thickness or length of the variable elastic under band, changing the type of elastomer(s) used, changing fabric materials and/or adding polymer coatings and layers, or substituting a particular prior art strap design for various portions of the disclosed bungee bras 10, 10*a*, 10*b* and variable elastic under bands 15, 15*a*, 15*b*, 15*c* and 15*d*. Many additional substitute materials and structures exist in the prior art that can be used as a substitute for the disclosed components if they can provide a similar function. Therefore, the disclosed examples and methods are well adapted to attain the ends and advantages mentioned as well as those that are inherent therein. The embodiments disclosed herein are illustrative only, as the teachings of the present disclosure may be modified and practiced in different but equivalent manners apparent to those skilled in the art having the benefit of the teachings herein. Thus, various seams can be added to the disclosed example bungee bras for facilitating easier assembly while maintaining the disclosed novel structures. For example, the disclosed bungee bras can have a separate under band and main body which can be seamed together just above the under band. Further, the sewn seams 17 and 17*a-f* can be replaced with other seam bonding methods that are common to the textile industry. Other improvements are also possible, such as the addition of a clasp (i.e., a plurality of hooks and eyelets) along one side of the bungee bra to allow the front and back panels to be detachable on one side. This can make the bungee bra easier to put on and take off. The pleated upper band 16, and the lower band 18 can also have similar clasp connectors. The ability to adjust one side of the bungee bra with a clasp can make the under band diameter adjustable to assist in providing the perfect fit.

Furthermore, no limitations are intended to the details of construction or design herein shown, other than as described in the claims below. It is therefore evident that the illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each can refer to only A, only B, or only C; any combination of A, B, and C; and/or at least one of each of A, B, and C.

What is claimed is:

1. A support bra for a person, comprising:

a elastic fabric body formed from one or more layers of an elastic fabric, wherein the elastic fabric comprises an elastomer portion that provides the elastic nature for the clastic fabric;

a variable clastic under band defined at a lower portion of the elastic fabric body and forming a loop of elastic material around the lower edge of the support bra;

wherein the elastic fabric body defines one or more shoulder straps at an of the clastic fabric body;

wherein the variable elastic under band defines a top portion and a bottom portion, and wherein the top portion having a larger elastic coefficient and a larger thickness than the bottoms portion, whereby the tendency for the bottom portion to curl up or roll up during use is reduced because of the larger thickness of the top portion;

wherein the elastic fabric is continuous across a cup area of the support bra.

2. The support bra in claim 1, wherein the top portion comprises a single layer of the elastic fabric body plus a pleat of elastic fabric, wherein the bottom portion comprises a single layer of the elastic fabric body.

3. The support bra in claim 2, wherein the pleat of elastic fabric comprises a portion of the elastic fabric body.

4. The support bra in claim 1, wherein the variable elastic under band is attached to the elastic fabric body using a method selected from the group consisting of a stitched seam, a thermally bonded seam, an adhesive or glue bonded seam and a continuation of the elastic fabric body to form the variable elastic under band.

5. The support bra in claim 1, wherein the elastic fabric body comprises two or more layers of the elastic fabric, wherein the two or more layers are laid one atop one another and attached at one or more edges of the two or more layers.

6. The support bra in claim 1, wherein the top portion of the variable elastic under band comprises an elastic polymer band, wherein the elastic polymer band provides a larger elastic coefficient at the top portion of the variable elastic under band than at the bottom portion.

7. The support bra in claim 1, wherein the variable elastic under band comprises a tapered elastic polymer band, wherein the tapered elastic polymer band is thicker at the top portion than at the bottom portion, wherein the top portion defines a larger elastic coefficient than at the bottom portion, whereby the top portion provides a greater elastic tension than the bottom portion during use.

8. The support bra in claim 1, wherein the elastic fabric comprises two relaxed elastic zones each for holding a breast of the person, wherein the elastic fabric in the two relaxed elastic zones is thermally deformed to provide a predetermined and varying amounts of deformation at different locations, whereby the elastomer portion of the elastic fabric having variable amount thickness within the two relaxed elastic zones to provide a more even pressure and support for each breast of the person during use.

9. The support bra in claim 1, wherein the variable elastic under band comprises a tapered elastic polymer band that is attached to a lower portion of the elastic fabric body, wherein the tapered elastic polymer band is thicker at the top portion than at the bottom portion.

10. A support bra for a person, comprising:

a elastic fabric body formed from one or more layers of an elastic fabric with an elastomer portion integral with the clastic fabric;

a variable clastic under band defined at a lower portion of the elastic fabric body and forming a loop of elastic material at a bottom edge of the support bra;

wherein the clastic fabric body defines one or more shoulder straps at an of the elastic fabric body and two cup areas on a front portion of the support bra, wherein the two cup areas each define a relaxed elastic zone for holding a breast of the person, and wherein the variable elastic under band comprises a top portion and a bottom portion, wherein the top portion defines a larger elastic coefficient and a larger thickness of elastic fabric than the bottom portion, whereby the tendency for the bottom portion to curl up or roll up during use is reduced because of the larger thickness of the top portion;

wherein the variable elastic under band comprises one or more pleats of elastic fabric stacked together to define three or more elastic fabric layers at the top portion and less than the three or more clastic fabric layers at the bottom portion.

11. The support bra in claim 10, wherein the variable elastic under band comprises one or more pleats of elastic fabric stacked together to define three or more elastic fabric layers at the top portion and less than the three or more elastic fabric layers at the bottom portion.

12. The support bra in claim 10, wherein the top portion of the variable elastic under band comprises an elastic band, wherein the top portion of the variable elastic under band contains a larger density per area of elastic material than the bottom portion.

13. The support bra in claim 10, wherein the elastic fabric body comprises two or more sheets of the elastic fabric laid one atop one another and attached at one or more of edges of the two or more sheets.

14. The support bra in claim 10, wherein the relaxed elastic zones display a variable elasticity in the elastic fabric, whereby the elastomer portion of the elastic fabric within the relaxed elastic zones have different elastic coefficients in different portions of the relaxed elastic zones to provide a more even pressure and comfort for each breast of the person during use.

15. The support bra in claim 10, wherein the elastic fabric is continuous across the two relaxed elastic zones of the support bra.

16. A support bra for a person, comprising:

a elastic fabric body formed from one or more layers of an elastic fabric, wherein the elastic fabric comprises an elastomer portion integral with the elastic fabric;

an under band attached at a lower portion of the elastic fabric body and forming a loop of elastic material at the bottom edge of the support bra;

wherein the elastic fabric body defines one or more shoulder straps at an upper portion of the elastic fabric body and two cup areas at a front portion of the elastic fabric body, wherein the two cup areas each define a relaxed elastic zone for holding a breast of the person;

wherein the two relaxed elastic zones are thermally deformed to define a variable elasticity across the elastic fabric and deform the two cup areas to an optimal shape for the person's breast size, whereby the elastomer portion of the elastic fabric within the two relaxed elastic zones have been relaxed by different elastic coefficient amounts in different location to provide an even pressure and better support for each breast of the person;

wherein the under band is a variable elasticity under band comprising a top portion and a bottom portion, wherein the top portion defines having a larger elastic coefficient and a larger thickness than the bottom portion.

* * * * *